US008926291B2

(12) United States Patent
Orndorff et al.

(10) Patent No.: US 8,926,291 B2
(45) Date of Patent: Jan. 6, 2015

(54) SPEED CONTROL FOR DIAPHRAGM PUMP

(76) Inventors: Michael Orndorff, Douglasville, GA (US); Scott Driscoll, Atlanta, GA (US); Jevawn Roberts, Atlanta, GA (US)

( * ) Notice: Subject to any disclaimer, the term of this patent is extended or adjusted under 35 U.S.C. 154(b) by 448 days.

(21) Appl. No.: 13/185,433

(22) Filed: Jul. 18, 2011

(65) Prior Publication Data

US 2012/0051945 A1 Mar. 1, 2012

Related U.S. Application Data

(60) Provisional application No. 61/365,516, filed on Jul. 19, 2010, provisional application No. 61/417,458, filed on Nov. 29, 2010.

(51) Int. Cl.
*F04B 49/20* (2006.01)
*F04B 43/073* (2006.01)
*F04B 49/06* (2006.01)

(52) U.S. Cl.
CPC ..... *F04B 43/0736* (2013.01); *F04B 49/065* (2013.01); *F04B 49/20* (2013.01); *F04B 2201/0207* (2013.01)
USPC ..... 417/28; 417/12; 417/46; 417/395

(58) Field of Classification Search
USPC ..... 417/26, 28, 42, 43, 46, 63, 395, 12
See application file for complete search history.

(56) References Cited

U.S. PATENT DOCUMENTS 5,174,731 A 12/1992 Korver
5,257,914 A 11/1993 Reynolds
5,332,372 A * 7/1994 Reynolds ..... 417/393
6,129,525 A 10/2000 Reynolds
6,625,519 B2 * 9/2003 Goodwin et al. ..... 700/282
7,517,199 B2 4/2009 Reed
7,658,598 B2 2/2010 Reed
7,811,067 B2 10/2010 Dietzsch
8,382,445 B2 * 2/2013 Roseberry ..... 417/46
8,485,792 B2 * 7/2013 McCourt et al. ..... 417/53
2006/0104829 A1 5/2006 Reed
2007/0154321 A1 * 7/2007 Stiles et al. ..... 417/44.1
2008/0260540 A1 * 10/2008 Koehl ..... 417/44.2
2009/0202361 A1 * 8/2009 Reed et al. ..... 417/46
2010/0310382 A1 * 12/2010 Kidd et al. ..... 417/12

OTHER PUBLICATIONS

Overspeed Controller Model 1015, Air Pump Valve Corporation Webpage, date at least as early as Jul. 18, 2010.
Yamada DRD-100 Dry Run Detector, brochure, date at least as early as Jul. 18, 2010.

* cited by examiner

*Primary Examiner* — Devon Kramer
*Assistant Examiner* — Charles W Nichols
(74) *Attorney, Agent, or Firm* — Rachel H. Huffstetler; FisherBroyles, LLP

(57) ABSTRACT

A liquid pump control system for dry run avoidance and re-prime detection. Pump dry run conditions can be detected with improved sensitivity by measuring pump cycle speed. Pump cycle speed is determined from sensors including pressure sensors, diaphragm end of stroke indicators, check valve movement sensors, and other techniques. A controller closes a valve to reduce pump cycle speed by reducing drive air pressure or by deadheading the pump liquid outlet. When the pump re-primes, the valve is opened, pump cycle speed increases, and pumping volume flow rate increases until a dry run condition is again encountered. Time delays can be introduced to delay shutting down or restarting the pump, for example to give a liquid source tank time to refill. The improved control sensitivity provides improved shut-down and re-start performance, reducing wear on the pump and reducing wasted drive air and energy consumption.

39 Claims, 5 Drawing Sheets

SPEED CONTROL FOR DIAPHRAGM PUMP

CROSS REFERENCE TO RELATED APPLICATIONS

The disclosures of provisional U.S. Provisional Patent Application Nos. 61/365,516, filed Jul. 19, 2010, and 61/417,458, filed Nov. 29, 2010, are incorporated herein by reference. This application hereby claims priority from each of the aforementioned Provisional Patent Applications.

BACKGROUND OF THE INVENTION

Field of the Invention and Prior Approaches

The present invention is directed generally to air- or fluid-powered diaphragm pumps including air operated diaphragm (AOD) pumps. More specifically, the present invention is directed toward apparatus and methods for controlling the speed or frequency of such diaphragm pumps. Still more specifically, the present invention relates generally to apparatus and methods for reducing wear on AOD pumps and the waste of energy and air or power fluid when the pump runs dry.

Air-operated diaphragm pumps are widely used for pumping liquids, solutions, viscous materials, slurries and suspensions containing solids. Typically, diaphragm pumps are operated under extreme operating conditions that vary widely. Specifically, the viscosity of the liquid being pumped can vary, particularly when the liquid is a suspension containing solids, and the system head can drop dramatically when the liquid source tank runs dry (the pump loses prime).

Diaphragm pumps are a type of positive (or semi-positive) displacement pump that use an energy source to move a diaphragm back and forth. By having one-directional check valves on the inlet and outlet, this reciprocating motion alternately pulls liquid into and pushes liquid out of the pump. One type of diaphragm pump is the air operated diaphragm (AOD) pump, which typically uses compressed air to power the diaphragm movement.

AOD pumps have several important advantages over other types of pumps—including being intrinsically safe by design, able to handle solids in the liquid being pumped, able to handle deadhead conditions without hurting the pump, being self-priming, and able to go in and out of prime (including dry-running) without hurting the pump.

Dry-running occurs when the supply tank becomes empty or is close to empty, and the pump only draws air or a mixture of air and liquid (skimming). Without the resistance provided by the liquid or slurry normally being pumped, the pump enters into a runaway condition in which its speed and energy use increase dramatically. The end result is that the most energy is used when the pump is not actually moving much or any of the working material. In addition, although dry-run operation does not cause immediate damage, it does cause increased wear and tear as there is no liquid to dampen and slow the internal movement. Despite the energy loss and accelerated wear, AOD pumps are nonetheless often used in situations where dry-run is likely because they can survive in these conditions, whereas other pump types would experience catastrophic damage or require re-priming systems.

In addition to speed changes cause by dry-running and re-priming, AOD pump frequency will often change dramatically due to changes in head pressure. In many situations, changes in speed may be undesirable. For instance, filling or measuring applications.

While pump speed or frequency governors for fluid powered diaphragm pumps are known from, e.g., U.S. Pat. Nos. 3,741,689 and 6,129,525, the teachings of which are incorporated herein by reference, such devices are complicated, difficult to install and not feasible for use as a retrofit or add-on feature to existing pumps.

The most common solution to the problem of pumps running dry is the use of a level sensor to measure the level of liquid at the pump source (e.g. a tank, sump, etc.). The most common (and cheap) level-sensing solution uses a mechanical float switch: when the float gets below a certain threshold, air to the pump is interrupted to keep it from running dry. Once the tank fills back up, the float rises and air flow is restored to the pump. There are many variations on this same setup, and there are many different types of level sensors other than a mechanical float, including optical, ultrasonic, radar, etc. All of such approaches, however, share the same general concept: detecting the level of the liquid being pumped and opening or closing a valve to/from the pump accordingly.

Yet, the level sensing approach has several problems/complications. First, it requires some type of sensor/switch to be submerged in or mounted around the liquid being pumped. This can cause problems such as the physical corrosion or contamination of parts exposed to the liquid flow. The level sensing approach also typically requires on a very stable physical mounting arrangement that is unfortunately not compatible with heavy industrial environments.

Level sensing solutions also typically require the reservoir from which liquid is being pumped to be relatively stable and uniform. Many industrial applications, however, must handle a variety of liquids (and even solids suspended in liquids) whose characteristics (density, viscosity, reflectivity, etc.) can vary significantly and thus will cause measurement problems. Of the sensors that make contact with the target liquid, they oftentimes get stuck or are damaged. And although there are some sensors contact-less sensors that can handle these situations, they are very expensive and can require complex calibration.

The problem of dry-run over-speed has also been addressed to some extent by Overspeed Controller Model 1015 marketed by Air Pump Valve Corporation, which is designed to be used with both diaphragm and piston air operated pumps. But the Model 1015 relies on an indirect measurement of flow from pressure drop, which is an unreliable indicator of dry-run because the flow may only increase a small amount—10 to 15% in many applications. Model 1015 and similar solutions (e.g. the Yamada DRD-100 Dry Run Detector) are also hindered by changes in system air pressure due to other plant equipment on the same air supply. Unless the pump is running with a dedicated compressor, the air flow sensing approach of these solutions is unable to reliably differentiate between a loss of prime condition and a drop in air supply caused by a pump turning on nearby.

Therefore, although there are known solutions to the energy waste and accelerated wear caused by dry-run conditions for AOD pumps, those solutions are not robust or very expensive. There is a need for solutions that don't require sensing the level of the source liquid and that provide more control sensitivity and accuracy than can be obtained from monitoring drive air flow and pressure.

There is a need for an improved air- or fluid-powered diaphragm pump with speed control that can respond appropriately to dry-run conditions and changing system pressure. Due to the large number of air- and fluid-powered diaphragm pumps in current use, it would also be desirable to provide such a system that could be readily added on or retrofitted to existing pump systems.

SUMMARY OF THE INVENTION

The present invention satisfies the needs and shortcomings discussed above by providing a liquid pump control apparatus and method with improved performance before and after dry run events.

In one preferred embodiment, the method provided by the present invention includes providing a pump assembly that comprises an air operated pump, an air inlet, an air exhaust, a liquid inlet, and a liquid outlet. The method further provides a pump stroke sensor in communication with the pump assembly that senses pump operating speed and provides for reducing pump operating speed in response to the pump operating speed exceeding a first threshold value.

As a result, if a dry run condition is encountered, the pump assembly reduces pump cycle speed to avoid wear on the air operated pump and reduce waste of drive air and energy.

In another preferred embodiment, a method for controlling a liquid pump assembly is provided that includes providing a liquid pump assembly that comprises an AOD pump, an air inlet, an air exhaust, a liquid inlet, and a liquid outlet. The method senses pump operating speed and reduces pump operating speed in response to pump operating speed exceeding a first threshold value.

In a preferred embodiment, the method for controlling a liquid pump assembly also includes sensing a subsequent drop in pump cycle speed that indicates that the pump has been re-primed. The method includes increasing pump cycle speed upon re-prime so that full pump liquid volume flow rate can be restored. Time delays can also be included, such as to avoid premature re-start of the pump upon re-prime or to provide time for a liquid source tank to be refilled.

In another embodiment, a liquid pumping system comprises an air operated pump having an air inlet, an air exhaust, a liquid inlet and a liquid outlet. The system also includes a pump speed sensor that is operatively connected to the air operated pump and that has an operating means to determine the pump cycle speed of the air operated pump. The system further includes a controller operatively connected to the pump speed sensor and the air operated pump. The liquid pumping system controls pump cycle speed in response to signals from the pump speed sensor.

In a preferred embodiment, the liquid pumping system also includes a controller in communication with the pump speed sensor and a valve controlled by the controller and in fluid communication with the air inlet. To reduce pump cycle speed under a dry run condition, the controller closes the valve. When re-prime condition is detected, the controller opens the valve.

According to one preferred embodiment, the pump speed sensor comprises a pressure sensor measuring air inlet pressure variations over time to infer pump cycle speed from the frequency content of the measurement. Alternatively, the pump speed sensor make comprise and end-of-stroke detector, a check valve movement detector, vibration or acoustic detectors, or any other means for determining pump cycle speed.

It is therefore an advantage of the present invention to provide a method and apparatus for improved control of a liquid pump assembly.

Another object of the present invention is that it provides an improved method and apparatus for controlling a liquid pump assembly before and after dry stop conditions are encountered.

Still another advantage of the present invention is that it provides a method and apparatus for controlling a liquid pump that reduces wear on the pump and reduces wasted energy and drive air supply in the operating environment of the pump.

Yet another advantage of the invention is that it provides an apparatus and method for improved control of AOD pumps before and after dry stop conditions are encountered.

The present invention is able to more robustly detect dry-run conditions than existing flow and pressure based devices since the present invention measure pump speed rather than flow, and pump speed changes much more dramatically than flow during dry-run conditions. The measurement of pump speed also enables it to better differentiate between dry-run and other environmental changes, such as changes in system pressure.

Still yet another advantage is that no contact with or measurement of the working liquid is required.

Other objects and advantages of the present invention will become apparent to those skilled in the art upon reviewing the following detailed description, drawings and claims.

DETAILED DESCRIPTION OF THE INVENTION

Figure 1:
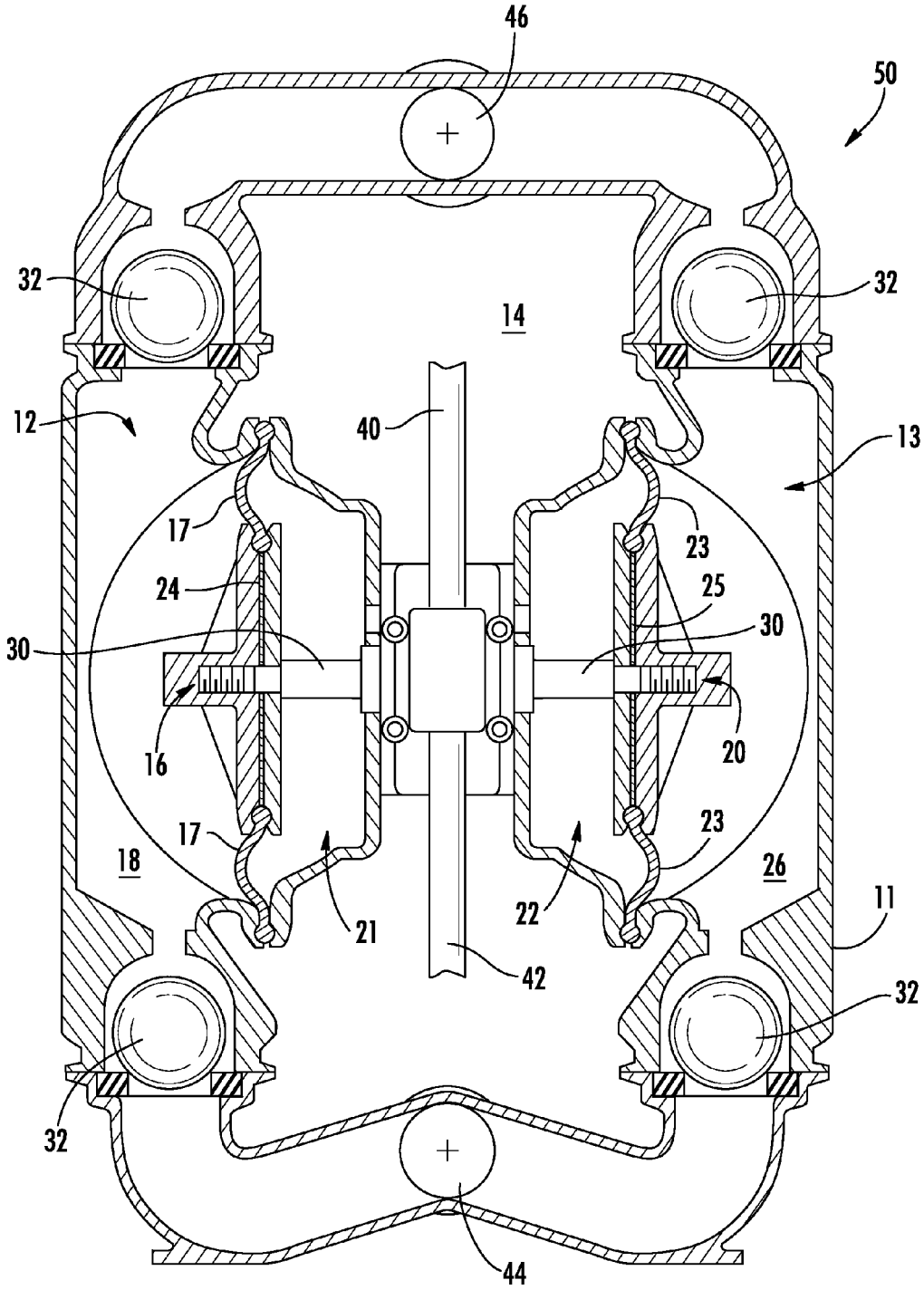
FIG. 1 is a schematic illustration of an AOD pump employed by the apparatus and methods of the present invention.

Referring now to the drawings, wherein what are shown for purposes of illustrating certain embodiments of the invention only and are not for purposes of limiting the same, FIGS. 1-6 illustrate the present invention.

A significant advantage of the method and apparatus of the present invention is that it offers improved detection of dry run conditions in pumping environments, enabling the pump to be shut down or for pump speed to be reduced in response to such conditions, thereby saving energy and reducing pump wear. Although the invention is described in terms of apparatus and methods in connection with an air operated double diaphragm (AOD or AODD) pump, the invention may be utilized with any type pump chosen with sound judgment by a person of ordinary skill in the art.

Hereinafter, the term "compressed air" and "compressed fluid" may be used interchangeably, as may the terms "air" and "fluid;" such terms refer to the air or fluid driving the pump, as distinguished from the process "liquid" that is being moved by the pump. The process "liquid" can include without limitation slurries, mixtures of solids, liquids, and/or gases, or anything else that can flow through a pump. "Air" also means atmospheric air or any other gas. "Vibration" means any mechanical movement as could be measured by accelerometer.

"Acoustic" refers to sound waves propagating through a solid, liquid or gas. "Measuring pressure" includes average or root-mean-square pressure as well as measuring pressure over a period of time that is sufficiently long enough to derive frequency information (such as pump cycle speed) from the measurements. "Reducing" pump operating speed means reducing pump speed or turning the pump off completely. "Controller" means any kind of electronic or other controller for accepting sensor inputs and controlling valves and other control devices. "Pump cycle speed" and "pump speed" mean pump cycle frequency or pump oscillation rate, such as for example the oscillating frequency or rate of the pumping chambers within an AOD pump. A "dry run" condition means any condition in which the pump has lost full prime and is not pumping from a completely full liquid inlet, and doesn't necessarily mean that the liquid source tank or the liquid inlet are completely dry.

Overview

With reference now to FIG. 1, a typical AOD pump 50 such as is well known in the art will generally be described. The pump 50 may comprise a housing 11, a first diaphragm chamber 12, a second diaphragm chamber 13, a center section 14, and a power supply (not shown). The first anterior diaphragm chamber 12 may include a first diaphragm assembly 16 comprising a first diaphragm 17 and a first diaphragm plate 24. The first diaphragm 17 may be coupled to the first diaphragm plate 24 and may extend across the first anterior diaphragm chamber 12 thereby forming a movable wall defining a first pumping chamber 18 and a first interior diaphragm chamber 21. The second anterior diaphragm chamber 13 may be substantially the same as the first anterior diaphragm chamber 12 and may include a second diaphragm assembly 20 comprising a second diaphragm 23 and a second diaphragm plate 25. The second diaphragm 23 may be coupled to the second diaphragm plate 25 and may extend across the second anterior diaphragm chamber 13 to define a second pumping chamber 26 and a second interior diaphragm chamber 22. A connecting rod 30 may be operatively connected to and extend between the first and second diaphragm plates 24, 25. Check valves 32 allow the discharge and suction of process liquids being pumped.

As compressed drive air or fluid flows through air inlet 40 into either the first or second interior diaphragm chambers 21 or 22 and out air exhaust 42, first and second flexible diaphragms 17 and 23 may flex toward or away from center section 14 with first and second diaphragm plates 24 and 25. This motion forces process liquid into or out of first or second pumping chambers 18 or 26, and check valves 32 will seat or release according to the positive or negative relative pressure induced. First and second anterior diaphragm chambers 12 and 13 oscillate or cycle back and forth as pressurized air is distributed alternately between them. As a result, process liquid is thereby forced from a process liquid source (such as a source tank) through liquid inlet 44 into AOD pump 50, through check valves 32, out liquid outlet 46 and toward a process liquid destination (such as a destination tank).

Figure 2:
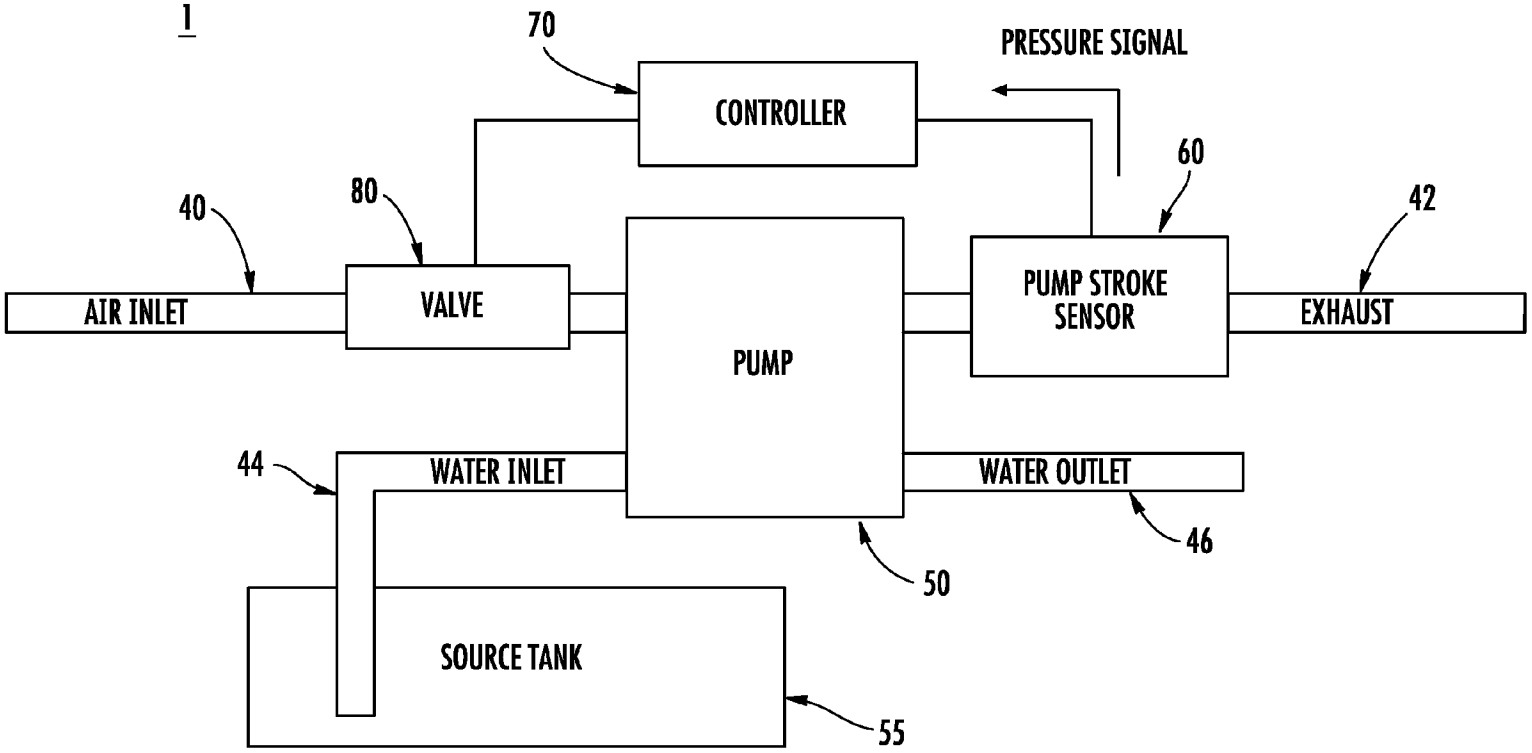
FIG. 2 is a liquid pump assembly provided by the present invention.

With reference now to FIG. 2, a block diagram according to one embodiment of the present invention will be described. According to this advantageous embodiment, liquid pump assembly 1 comprises an AOD pump 50 that operates according to discussion above in connection with FIG. 1. Pressurized drive air enters through air inlet 40 and exits through air exhaust 42, compelling pump 50 to pump process liquid from source tank 55 into liquid inlet 44, through pump 40, and out liquid outlet 46.

Under normal operating conditions, the speed of pump 50 can be increased simply by increasing the pressure or flow rate of the drive air delivered to air inlet 40, and the volume of process liquid pumped will increase accordingly. If, however, the source tank 55 runs dry, pump speed will increase dramatically even though little or no process liquid is being pumped. Increased pump speed under such dry run circumstances has several undesired results, including wasted energy, wasted pressurized air, and increased wear on pump 50.

According to one advantageous embodiment, liquid pump assembly 1 limits pump speed during dry run conditions. Pump stroke sensor 60 is adapted to measure or detect the oscillating frequency (i.e. the pump stroke frequency) of first and second diaphragm chambers 12 and 13 and thus the "speed" of pump 50 generally. Generally speaking, pump stroke sensor 60 provides pump speed information to controller 70, and controller 70 reduces pump speed, or turns pump 50 completely off, through a pump control mechanism such as valve 80 in communication with drive air inlet 40. For example, if valve 80 is located in series with drive air inlet 40, controller 70 can stop pump 50 simply by closing valve 80 to remove the compressed air driving pump 50. So as source tank 55 runs dry, pump stroke sensor 60 detects an increase in the oscillation or speed of pump 50, and provides that information to controller 70. Controller 70 then limits or stops pump 50 by limiting pressurized drive air by operating valve 80.

According to other advantageous embodiments of the invention, some or all of the components of pump assembly 1 can be located remotely from component pump 50. For example, without limitation, an existing pump installation can be modified or retrofitted with remotely-located components for ease of modification. In a further example, in pumping environments where immersion in explosive gases poses a problem, the electrical components and/or power supply components of pump system 1 may be remotely located from pump 50.

According to other advantageous embodiments of the invention, some or all of the components of pump assembly 1 can be fully integrated rather being implemented as separate components. For example, without limitation, pump stroke sensor 60 can be integrated with controller 70 or controller 70 can be integrated with pump 50. Those skilled in the art will appreciate that the location of and level of integration of the components of pump assembly 1 may be varied considerably without departing from the scope of the present invention.

Pump Stroke Sensor

Pump stroke sensor 60 may be implemented according to the present invention in many ways. In a particularly advantageous set of embodiments, the pump stroke sensor measures or detects pump oscillations, or pump cycle speed. This set of embodiments in which pump cycle speed is detected contrasts with prior art pump speed limitation approaches that are based on air/fluid consumption or flow; source tank liquid level; or liquid density, reflectivity, or other characteristics. Because pump cycle speed is a better indicator whether a pump is operating in a primed vs. unprimed (i.e. dry) condition, this set of embodiments is particularly advantageous for avoiding pump wear and air/energy waste under unprimed/dry conditions. In particular, as pump 50 runs dry, the oscillation or cycle speed of pump 50 increases significantly (sometimes by a factor of two or more) and thus provides an excellent indication that a dry-run condition has been encountered.

In one particularly advantageous embodiment, pump stroke sensor 60 is implemented by mounting a pressure sensor in fluid communication with air exhaust 42 and measuring or detecting the air exhaust pressure as a function of time. The cycle speed of the pump 50 can then be readily ascertained as the frequency of the detected pressure signal as it oscillates over time.

Pump stroke sensor 60 can also be implemented by mounting a pressure sensor in fluid communication with air inlet 40, liquid inlet 44, or liquid outlet 46. Alternatively, a flow meter rather than a pressure sensor can be mounted at or near air exhaust 42, air inlet 40, liquid inlet 44, or liquid outlet 46 if the flow meter is sufficiently responsive to detect flow changes at a frequency corresponding to the maximum speed of pump 50. Still alternatively, the pump stroke sensor may be implemented with an acoustic sensor that is in acoustic communication with pump 50, air inlet 40, air outlet 42, liquid inlet 44, or liquid outlet 46. In another alternate embodiment of the invention, the pump stroke sensor may be implemented with a vibration sensor that is mounted on or near the housing 11 of pump 50 or on or near any other component of pump assembly 1. The cycle speed of the pump 50 can then be readily ascertained as the frequency of the detected pressure signal, vibration signal, or acoustic signal as such signal oscillates over time.

Pump stroke sensor 60 can also be implemented by mounting a linear displacement sensor, contact closure switch, or other mechanical sensor in communication with a moving component of the pump 50. For example, end-of-stroke limit switches could be used in communication with the first or second diaphragm plates 24 or 25, in communication with the check valves 32, in communication with the valve spool or other component of the drive air valve that routes pressurized air alternatingly to first and second diaphragm chambers 21 and 22, or in communication with any other component of pump 50 that moves in conjunction with pump oscillation. The cycle speed of the pump 50 can then be readily ascertained as the frequency of the detected displacement signal as it oscillates over time.

Pump stroke sensor 60 can also be implemented by mounting an accelerometer in communication with pump housing 11, in communication with any other component of pump 50 or of pump assembly 1, or in communication with any of air inlet 40, air exhaust 42, liquid inlet 44, or liquid outlet 46. The cycle speed of the pump 50 can then be readily ascertained as the frequency of the detected accelerometer signal as it oscillates over time. Indeed, any measurement of any physical properties of the components of, inputs to, or outputs from pump assembly 1 that correlate in time with the cycle speed of pump 50 can be employed without departing from the scope of the present invention.

Reducing Pump Speed

Pump assembly 1 can reduce pump speed or stop pump 50 completely through several advantageous mechanisms. In one particularly advantageous embodiment of the invention, after controller 70 determines that the speed of pump 50 is too high, controller 70 can partially or fully close a valve 80 that is in fluid communication with air inlet 40, interrupting the supply of pressurized drive air or drive fluid to thereby reduce the speed of or turn off pump 50. Without departing from the present invention, valve 80 can be any type of valve or other device known in the art for limiting the flow of pressurized air or fluid. For example, without limitation valve 80 can be a solenoid-driven butterfly valve, a poppet valve, or a fixed or controllable pressure regulator in electrical communication with controller 70. Alternately, some combination of valves and fixed and controllable pressure regulators could be employed without departing from the invention. Still alternatively, valve 80 could be located in fluid communication with air inlet 40 to switch between the primary high pressure air supply and a lower pressure supply.

To reduce rather than stop air flow to pump 50, valve 80 can also have a small bypass tube or other bypass path that permits a small flow of air even when valve 80 is fully closed. Alternatively, valve 80 could be designed so that it never fully closes, permitting a small flow of air even in response to a command from controller 70 to "close" the valve.

Valve 80 can alternatively be located so as to be in fluid communication with liquid outlet 46 so that when valve 80 is closed pump 50 is "deadheaded" and thus effectively stopped. In still other alternate embodiments, valve 80 can be located so as to be in fluid communication with liquid inlet 44 or air exhaust 42. Alternatively, multiple valves 80 can be located at some combination of air inlet 40, air exhaust 42, liquid inlet 44, and/or liquid outlet 46.

In another embodiment of the invention, controller 70 infers that a dry run condition is encountered if pump cycle speed increases dramatically and then levels off or stabilizes at a higher speed.

Re-Priming/Re-Starting

After pump assembly 1 determines that a dry stop condition has been reached and slows down or stops the pump 50, the pump can be re-primed or re-started using several alternative advantageous mechanism according to the invention. In one simple embodiment, the pump can be restarted manually and the pump stroke sensor 60 and controller 70 can use the aforementioned techniques to determine promptly whether or not the dry stop condition still exists (such as when the source tank 55 is still empty). If a dry stop condition is again detected, the pump speed will be reduced or stopped as described earlier. In one advantageous embodiment, a delay time is introduced between the time at which the pump speed is reduced or stopped and the time at which a re-start is initiated and the prime check recurs periodically until prime is detected and the pump can return to full speed to resume full liquid pumping volume rate of flow. The delay time between dry run detection and restart can be set in advance, can be user-selected, or can be configurable according to operating environment conditions. For example, the delay time could be increased successively after each unsuccessful check for prime until prime is detected, after which the delay time could revert to its initial value or another value. Alternatively, a fully-manual approach could be employed whereby the pump can only be re-started by a user input or a signal from another system in the operating environment. Still alternatively, some hybrid of any or all of the aforementioned re-start approaches could be employed without departing from the invention.

Alternatively, if the pump speed is merely slowed down (rather than fully stopped) in response to a dry run condition, the pump speed will necessarily slow down even further once the system has re-primed (such as when source tank 55 is no longer empty).

According to one embodiment of the invention, controller 70 can infer from this additional reduction in pump speed that the system has been re-primed (i.e. source tank 55 is no longer empty) and can then open valve 80 to move the pump assembly to normal operating speed. Still alternatively, the assembly could use a hybrid or combination of the aforementioned manual re-start after a long delay time combined with a reduced-speed mode within the longer re-start delay time intervals.

An alternative advantageous embodiment of the invention improves re-prime detection using a bypass valve with a pressure regulator. In this embodiment, the pressure regulator would be set to a low enough pressure level so that any re-priming would completely stop the pump. This contrasts with an air bypass that only restricts air flow, since a flow restriction would still allow the full system pressure to operate on the fluid. Using a pressure regulated bypass according to this embodiment may make re-prime detection easier in situations where there is not much change in pump speed between dry run and primed conditions while the pump is in a bypassed, low-speed mode. Rather than detecting a slow down, the system would only have to detect a complete stop.

In addition, a number of user-initiated manual control mechanisms can be employed without departing from the invention. For example, a user-activated switch or push button can be provided that will manually override the controller functions in order to initiate pumping operations immediately, overriding any re-start delay time established by controller 70. Or the assembly could respond to an input from another source such as an external system's control signal, an output from another sensor within the operating environment, etc. and override any delay time or reduced-speed mode. For example, a float sensor in source tank 55 could indicate a dangerously high level of liquid in the tank to override any delay time or reduced speed mode in order to restart pumping operations immediately.

Calibration and Correction

Pump assembly 1 can be advantageously calibrated to perform in a variety of operating environments. The system can be manually calibrated by having a user place pump assembly in a dry run condition (such as with an empty source tank 55). As the pump 50 operates in calibration mode at a high cycle speed in the dry run condition in that particular operating environment, the dry run threshold speed above which the pump speed is to be reduced in operation can be determined. The dry run threshold speed will typically be set with a speed margin somewhat below the speed at which the pump runs in dry run calibration mode; that margin can be set automatically via controller coding or by the user. Alternatively, the dry run threshold speed could be automatically set as the maximum speed at which the pump operates at any interval over the lifetime in which the pump assembly is installed in a particular operating environment.

In yet another alternative advantageous embodiment, the dry run threshold speed level could be set at the factory or before installation according to pump model number and projected installation environment (i.e. drive air pressure). Alternatively, an adjustment knob or other user adjustment mechanism could be provided to enable the dry run threshold speed to be adjusted in the field.

According to other aspects of the invention, the same mechanisms disclosed above for calibrating and adjusting dry run threshold levels can be employed to calibrate and adjust re-prime and re-start threshold levels.

In many industrial environments, there may be considerable variation in the pressure or flow rate of the drive air or drive fluid supplied to pump assembly 1. If, for example, the drive air pressure supplied to the pump assembly increases from 20 psi to 80 psi due to changes in the industrial environment, the speed of a typical AOD pump 50 might, for example, double. In light such possible environmental variations, one aspect of the present invention provides a correction mechanism to prevent pump assembly 1 from concluding that the doubled pump speed indicates a dry run condition and to prevent controller 70 from closing valve 80 in response to the (false) dry run indication. In one advantageous embodiment, pump assembly 1 includes a pressure sensor in fluid communication with air inlet 40 that measures or detects the average or root-mean-squared pressure of drive air delivered to pump 50. If the average or root-mean-squared pressure of the drive air changes considerably, controller 70 can adjust the dry run threshold cycle speed and/or the re-prime threshold speed. In one particularly advantageous embodiment, pump stroke sensor 60 is a pressure sensor located in fluid communication with air inlet 40 and that both detects the average pressure of drive air and also determines pump cycle speed.

Similarly, and without departing from the present invention, the pump assembly 1 can make adjustments to the dry run threshold speed and/or the re-prime threshold speed by monitoring the flow rate or pressure at air exhaust 42, at liquid inlet 44, or at liquid outlet 46.

According to yet another advantageous embodiment, the pump assembly 1 can incorporate detecting the average pressure at air inlet 40 into the dry run and re-prime detection mechanisms. In many operating environments, the average drive air pressure delivered to the pump 50 changes predictably depending on the availability of process liquid at liquid inlet 44. As the pump 50 runs dry, it typically speeds up and uses more air, which can cause the supply air pressure at air inlet 40 to drop if the main air supply cannot supply sufficient air or is inadequately regulated. Similarly, when the pump re-primes, the extra resistance and pump slow-down can lead to an increase in average pressure of the drive air at air inlet 40. Measures of the air pressure drop across valve bypass along with the absolute air pressure can be used to derive the air flow rate. According to this aspect of the invention, these air pressure measures can be used independently or in combination with pump cycle speed to adjust the delay time and cycle speed thresholds associated with determining dry run conditions and re-prime conditions.

According to yet another advantageous embodiment, the pump assembly 1 can include automatic calibration of fixed and adjustable thresholds for dry run and re-prime events. Instead of using a fixed pump speed threshold to determine dry run and re-prime events, the assembly can re-calibrate those thresholds over time. For instance, in one embodiment the pump assembly 1 could wait until the pump cycle speed plateaus or until it remains at some speed for some period of time after an increase in speed has occurred. For example, if the pump cycle speed increased steadily during a 2 minute period but didn't thereafter change or drop, controller 70 could conclude that a dry run condition had been encountered. According to this aspect, pump cycle rate acceleration is used by controller 70 to determine when a maximum pump speed has been attained and held. The approach of this embodiment would be beneficial in situations where system parameters that affect pump cycle rates change substantially over time (e.g. drive air pressure, process liquid type or composition, and drive air and process liquid plumbing configuration). According to yet another aspect, pump cycle rate acceleration could be combined with some absolute pump cycle rate criteria for determining dry run and re-prime events. For example, the pump cycle rate might still need to be both above some pre-determined threshold level and also relatively unchanging over time.

Hardware Implementation and Controller Coding

A pump assembly, including controller circuitry, electrical power supply (such as a battery), and controller software code, used to construct a liquid pump assembly 1 according to one advantageous embodiment of the present invention is disclosed in provisional U.S. Patent Application No. 61/365,516 (19 Jul. 2010), which is incorporated herein by reference.

Other Advantageous Embodiments—Net Positive Suction Head (NPSH)

In many pump operating environments, users may be required to ensure that pump speed is not so high as to cause the liquid inlet side to drop pressure too much, which can cause the liquid to boil and can induce cavitation and reduced pumping efficiency. This concern is particularly important in pump applications (such as non-AOD pump applications) where damage to the pump assembly may result from cavitation or loss of prime. Pump system designers often employ a design concept known as Net Positive Suction Head (NPSH). NPSH (a) (i.e. NPSH available) is a calculated or experimentally-derived value that embodies the specific application's ability to make fluid available to the suction system. NPHS(r) (i.e. NPSH required) is a value that indicates the required NPSH for a given pump in order to avoid cavitation. NPSH(r) is typically experimentally determined by the pump manufacturer for each type of pump manufactured. The pumping system designer can then ensure that NPSH (a) for a particular pump operating environment will be greater than the NPSH(r) over the range of projected operating conditions. Given the considerable variation of different pump operating environments, a relatively large safety margin generally has to be employed by the designer to ensure that NPSH(s) never drops below NPSH(r). In practice, this design consideration yields a pumping system configuration in which pump 50 is pumping at a pump speed well below the design speed maximum for that particular pump in that particular pump operating environment.

By employing assemblies and methods similar to the dry run avoidance system described above, the present invention in one advantageous embodiment provides a liquid pump assembly 1 in which pump cycle speed can be increased without exceeding NPSH (a) for a particular pump 50 and pumping environment. According to one aspect, AOD pump cycle speed is monitored according to the aforementioned techniques employing pump stroke sensor 60 and controller 70 is configured so that pump assembly 1 provides a range of pump cycle speeds (rather than just full-power, reduced-power, and pump stop modes). For example and without limiting the generality of the invention, in one aspect pump assembly 1 can employ a valve 80 comprising a continuously variable orifice, pressure regulator, or other continuously variable control mechanism. In yet another example, in another aspect of the invention the pump assembly 1 can employ a valve 80 comprising a discretely variable orifice, pressure regulator with discrete settings, or other control mechanism with discretely variable settings. In yet another embodiment, the pump assembly 1 of the invention could alternatively interject time delay pauses during some or all pump strokes in order to keep the overall average flow of the process liquid at a desired level.

According to one embodiment, the pump assembly 1 can first run at a relatively slow pump cycle speed that is known by the operator to correspond to an NPSH(r) value that is well below NPSH(a) for that pump 50 in that operating environment. Pump assembly 1 could then advantageously gradually increase the available drive air pressure at air inlet 40 (or reduce interjected time delay pauses) so as to gradually increase pump cycle speed, thereby gradually increasing the suction pressure from source tank 55 at liquid inlet 44. If pump cycle speed increases too much, cavitation between source tank 55 and liquid inlet 44 can occur and pump speed will then increase further and may vary dramatically. According to this aspect of the invention, controller 70 and pump stroke sensor 60 can detect this increased pump speed and speed variation, either separately or in combination, and the pump assembly 1 can infer that pump 50 is cycling too quickly because NPSH(r) has exceeded NPSH (a). Accordingly, the pump assembly 1 can then reduce pump speed by reducing drive air pressure via valve 80 or using other techniques for pump speed reduction disclosed herein. Pump speed can be reduced gradually until the system stabilizes without cavitation, as detected using pump stroke sensor and controller 70. Accordingly, in one embodiment of the invention, in response to an indication of pump speed instability from loss of prime is detected, the pump assembly is configured to reduce the cycle speed of pump 50 until desired operating conditions are restored. Likewise, periodically, the pump assembly according to another aspect can increase pump speed in order to determine whether a higher pump cycle speed (and thus improved pumping operations) can be achieved without cavitation or pump speed instability.

In yet another embodiment of the invention, the pump assembly can comprise a pressure sensor in fluid communication with the liquid inlet 44 to directly monitor liquid inlet pressure. When the pressure drops near the NPSH, the pump cycle speed can be stopped or reduced according to the apparatus and methods described herein for reducing pump speed.

Other Advantageous Embodiments—Non-AOD Pumps

The present invention is directed to pumping applications involving a wide range of classes of pump 50, including without limitation AOD pumps, pumps driven by compressed air or fluid, other positive displacement pumps, vacuum-driven pumps, AC motor driven pumps, and any type or class of pump that transfers a liquid volume via a mechanical work mechanism. Many classes and types of pump assemblies 1 share the operating characteristics and application considerations discussed herein with respect to AOD pumps and other liquid pumps, including without limitation the characteristic of a correlation between the cycle speed of pump 50 and a dry run or loss-of-prime condition at liquid inlet 44 and source tank 55.

In one advantageous embodiment of the present invention, a liquid pump assembly 1 comprises an AC motor driven pump 50 that operates at approximately the same pump cycle speed under primed and unprimed conditions. According to this aspect, the pump assembly 1 comprises a current meter measuring the electric current drawn by pump 50. When the electric current drawn drops below a threshold current level (indicating a loss of pump prime), the pump assembly 1 is adapted to reduce the pump cycle speed of pump 50, such as by reducing the electric supply power or reducing the alternating frequency of the AC power to pump 50.

According to yet another aspect of the invention, controller 70 in pump assembly 1 can provide a first threshold level of electric current draw below which an unprimed condition is indicated and a second threshold level of electric current draw above which a re-prime condition is indicated. When an unprimed condition is encountered by pump assembly 1, controller 70 reduces the cycle speed of pump 50. When a re-prime condition is encountered by pump assembly 1, controller 70 increases the cycle speed of pump 50.

In other advantageous embodiments of the current invention, the techniques and methods that are elsewhere disclosed herein for reducing pump speed, re-priming and re-starting, calibration and correction, and handling NPSH design considerations are employed in pump assemblies 1 that comprise non-AOD pumps. Accordingly, pump systems 1 that comprise any type or class of pump that transfers a liquid volume via a mechanical work mechanism are well within the scope of the present invention.

Methods

According to one very simple embodiment of the invention, a method for controlling a liquid pump assembly is provided such that (i) when pump cycle speed increases above a pre-determined first threshold after the pump has been pumping liquid normally (full speed mode), the pump cycle speed is reduced (reduced speed mode); and then (ii) when pump cycle speed decreases below a pre-determined second threshold after the pump has been in the reduced speed mode for a time, the pump cycle speed is increased to full speed mode. Step (i) corresponds to the pump running dry after running in full speed mode, while step (ii) corresponds to the pump being re-primed after running in reduced speed mode. As will be appreciated by those skilled in the art, one important advantage of this embodiment of the invention is that pump cycle speed provides a sensitive indication of both dry run conditions and re-prime conditions. Therefore, according to this embodiment, the method of controlling a liquid pump assembly provides improved control of the pump assembly, which advantageously reduces pump wear and energy and drive air loss.

For example, according to this simple embodiment, pump 50 in pump assembly 1 might be running at a cycle speed of 100 strokes per minute (spm) during normal operation in a given environment. So long as pump 50 is running below a predetermined threshold of 200 spm, pump assembly continues in full speed mode. If the liquid in source tank 55 drops too far or is removed, the cycle speed of pump 50 increases as a result of dry run condition. As the pump speed increases above the 200 spm threshold as a result of the dry run condition, pump stroke sensor detects the increased pump speed and controller 70 partially or fully closes valve 80 that restricts air from inlet 40, and pump 50 in response reduces speed and settles into reduced power mode at a pump cycle speed of, for example 50 spm.

If more liquid is introduced into source tank 55 to re-prime the pump assembly while pump assembly 1 is in reduced power mode, the pump cycle speed may drop below a second predetermined threshold of, say, 20 spm. Sensing this with pump stroke sensor 60, the controller 70 opens valve 80 to increase drive air to pump 50 at air inlet 40 and pump 50 responds by speeding up to full speed mode to resume full pumping volume flow rate.

In one aspect of the invention, a delay time is introduced before the pump assembly is permitted to return to full power mode, in order to avoid immediately running dry again (until, for example, the volume of source liquid in source tank 55 has increased sufficiently). This can help avoid skimming, which is less efficient than fully-primed pumping. According to another aspect, the delay time can be fixed in the controller based on the particular model of pump 50 and the expected operating environment. Operating environment parameters influencing the selection of a fixed delay time may include, for example without limitation, the rate at which source liquid is expected to be provided to source tank 55, the size of source tank 55, the length and diameter of pipe between the source tank and liquid inlet 44, and other operating environment parameters. For example, after detecting the end of the dry run condition, the pump assembly 1 might delay for 5 minutes to ensure there is sufficient source liquid in source tank 55 to justify returning the pump to full power mode. According to one embodiment, this approach advantageously prevents the pump from constantly cycling back and forth between full power mode and reduced power mode without ever achieving fully-primed, efficient pumping. According to another aspect, the time delay could also be variable, such as based on the period of time that the pump assembly remained in reduced power mode; for some applications, that time period could be used as an indication of how quickly liquid is being delivered to source tank 55. According to yet another embodiment, a delay time can be introduced between the time when dry run is detected and the time when the controller 70 closes valve 80. In yet another aspect of the invention, the controller 70 can confirm that pump cycle speed is remains above a threshold for a time period before 70 closes valve 80.

According to another very simple embodiment of the invention, a method for controlling a liquid pump assembly is provided such that (i) when pump cycle speed increases above a pre-determined first threshold after the pump has been pumping liquid normally (full speed mode), the pump cycle speed is reduced to zero (shutting the pump off completely); (ii) the controller 70 delays for a time period of, for example, 3 minutes; and then (ii) the pump cycle speed is increased to full speed mode until a dry run condition is again detected.

Without departing from the invention, variations or combinations of the two very simple embodiments described above (reduced power embodiment and complete shut-off embodiment) can be realized by dynamically varying the pump cycle speed threshold values and dynamically varying the delay times based on pump performance parameters and the operating environment. For example, according to one embodiment the pump assembly has an initial delay time of 1 minute for the initial reduced power mode state, and that time is stepwise increased for the subsequent reduced power mode state if the pump assembly reaches dry run too quickly. As will be known to those skilled in the art, without departing from the invention a number of combinations and sequences can be implemented in a pump assembly using pump cycle speed detection as a control mechanism to move back and forth between a reduced power mode and a full power mode in response to the presence and absence of a dry run condition.

Figure 3:
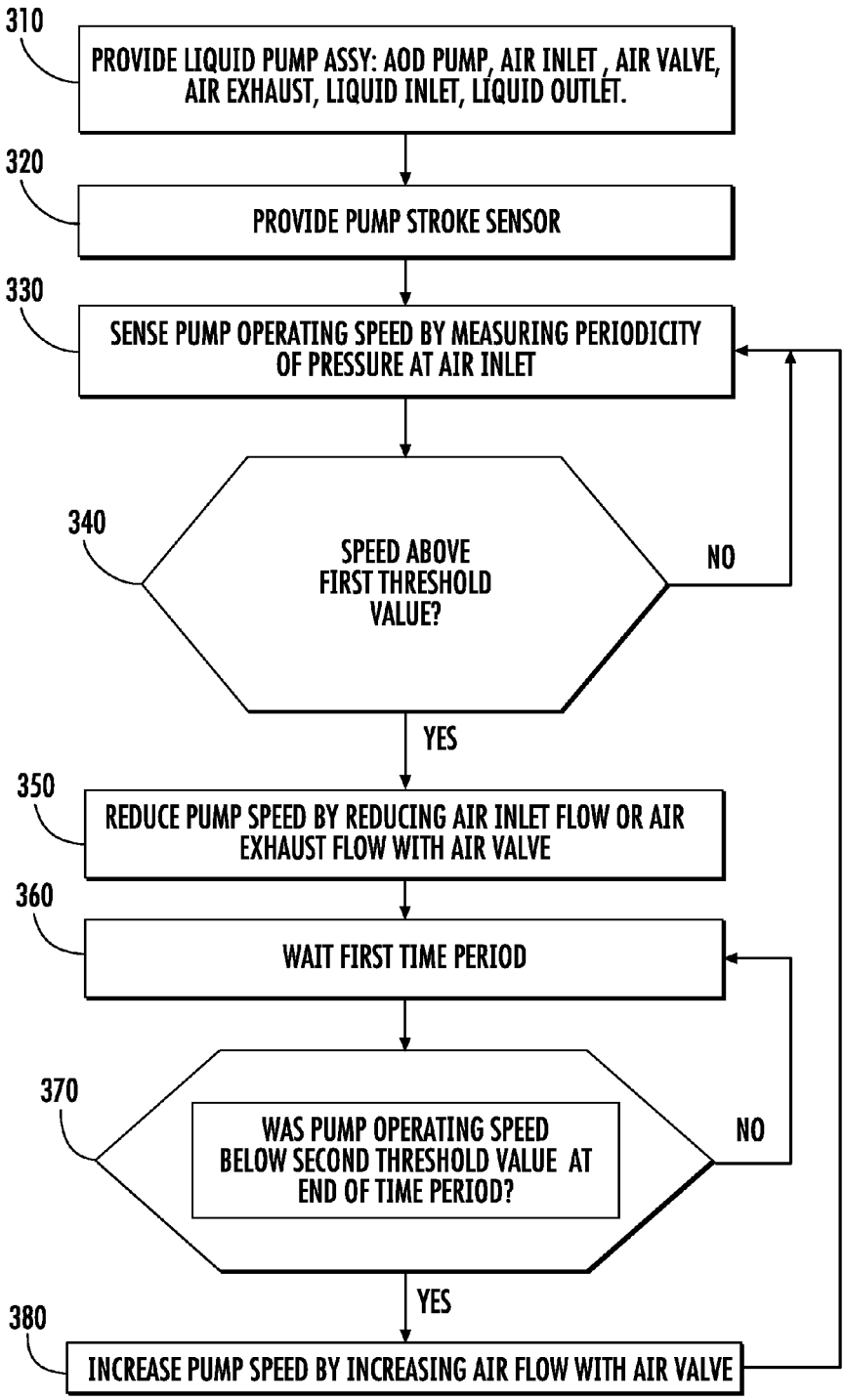
FIG. 3 is a flow diagram according to one of the methods provided by the present invention.

With reference now to FIG. 3, a method flow chart according to one embodiment of the present invention will be described. According to this advantageous embodiment, a method is provided for controlling a liquid pump assembly. In step 310, a liquid pump assembly is provided comprising an air operated diaphragm (AOD) pump, an air inlet, an air valve, an air exhaust, a liquid inlet and a liquid outlet. In step 320, the method provides a pump stroke sensor to measure or detect the pump cycle speed of the AOD pump. In step 330, pump operating speed is sensed by measuring the periodicity of pressure at a point in fluid communication with the air inlet. At step 340, if the pump operating speed is not above a first threshold value, then the method returns to step 330 to resume sensing pump operating speed. Advantageously, a delay can be introduced between step 340 and resuming sensing pump operating speed. But if the pump operating speed is above the first threshold value (indicating a dry run condition), then the method continues to step 350. In another embodiment of the invention, the method infers that a dry run condition is encountered if pump cycle speed increases dramatically and then levels off or stabilizes at a higher speed.

At step 350, the liquid pump assembly reduces pump operating speed by reducing the flow of pressurized air either into the air inlet or out of the air exhaust by controlling the air valve that is in fluid communication with either the air inlet or the air exhaust. At step 350, the liquid pump assembly according to the method waits a first time delay period before continuing to step 370. At step 370, if the pump operating speed was not below the second threshold value at the end of the first time delay period, the method returns to step 360 to wait another first time delay period. But if the pump operating speed was below the second threshold value at the end of the first time delay period (indicating a re-prime condition), the method moves to step 380, at which step the liquid pump assembly increases pump operating speed to resume full pumping volume flow rate by increasing the flow of pressurized air by controlling the air valve. Advantageously, a delay can be introduced between step 370 and increasing pump operating speed at step 380. After step 380, the method returns to step 330 to resume sensing pump operating speed.

Figure 4:
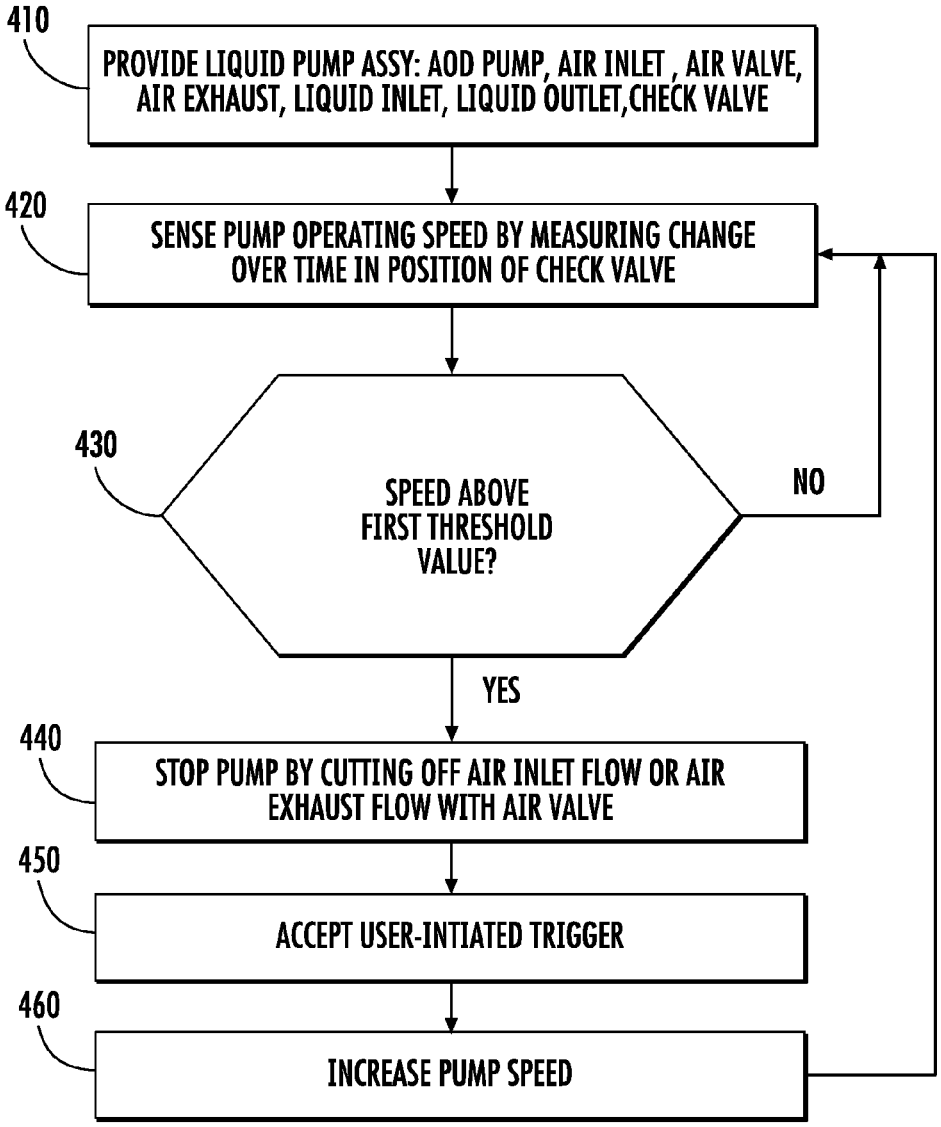
FIG. 4 is a flow diagram according to one of the methods provided by the present invention.

With reference now to FIG. 4, a method flow chart according to another embodiment of the present invention will be described. According to this advantageous embodiment, a method is provided for controlling a liquid pump assembly. In step 410, the method provides a liquid pump assembly that comprises an AOD pump, an air inlet, an air valve, an air exhaust, a liquid outlet, and a check valve. In step 420, the operating speed of the AOD pump is sensed by measuring or detecting the change over time in the position of the check valve. At step 430, if the operating speed of the AOD pump is sensed as being above a first threshold value, the method moves to step 440. If, however, the operating speed of the AOD pump is not sensed as being above the first threshold value then the method returns to step 420 to again sense pump operating speed.

At step 440, the AOD pump is stopped by cutting off the flow of pressurized air to the air inlet or from the air exhaust by operating the air valve in fluid communication with the air inlet or the air exhaust. The method then moves to step 450 to wait for a user-initiated trigger before moving to step 460. At step 460, the pump operating speed is increased by increasing the flow of pressurized air by controlling the air valve and the method returns to step 420 to again sense pump operating speed via the change over time in the position of the check valve.

Figure 5:
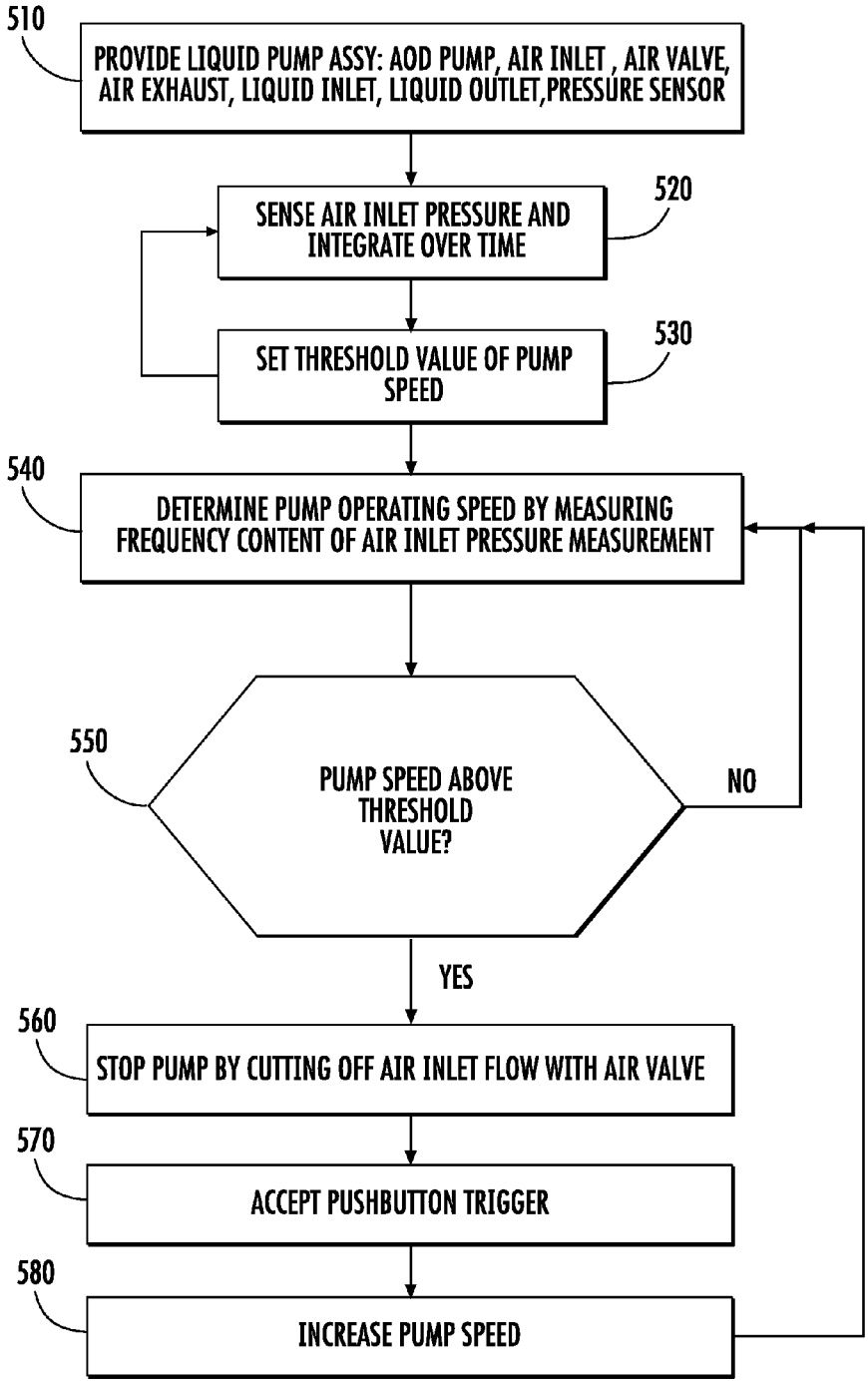
FIG. 5 is a flow diagram according to one of the methods provided by the present invention.

With reference now to FIG. 5, a method flow chart according to another embodiment of the present invention will be described. According to this advantageous embodiment, a method is provided for controlling a liquid pump assembly. In step 510, the method provides a liquid pump assembly that comprises an AOD pump, an air inlet, an air valve, an air exhaust, a liquid inlet, a liquid outlet, and a check valve. In step 520, the pressure at the air inlet is measured and integrated over time to determine an average or root-mean-square pressure at the air inlet. In step 530, the liquid pump assembly determines a threshold value for pump cycle speed based on the average pressure determined in step 520. The method at step 530 returns periodically or continuously to step 520 to periodically or continuously update the threshold value of pump speed. The method continues to step 540 to sense pump operating speed by measuring the change over time in the position of the check value to derive pump oscillation frequency. At step 550, the pump assembly compares the actual pump speed to the continuously-updated threshold value. If actual pump speed does not exceed the threshold value, the method returns to step 540 to continue sensing pump speed. If actual pump speed exceeds the threshold value, the method continues to step 560, at which step the AOD pump is stopped by cutting off the flow of air to the air inlet by closing the air valve in fluid communication with the air inlet. At step 570, the method waits for and accepts a push button trigger from an operator and then increases pump speed at step 580 to resume full pumping volume flow rate by opening the air valve to restore the flow of pressurized air to the AOD pump via the air inlet. The method then returns to step 540 to resume sensing pump operating speed by deriving pump frequency from position changes over time of the check valve.

In the drawings and the specification, there has been set forth preferred embodiments on the invention and although specific terms are employed, the terms are used in a generic and descriptive sense only and not for the purpose of limitation, the scope of the invention being set forth in the following claims.

The invention claimed is:

1. A method for controlling a liquid pump assembly comprising the steps of: providing a liquid pump assembly comprising an air operated diaphragm pump, an air inlet, an air exhaust, a liquid inlet, and a liquid outlet; sensing pump operating speed;

reducing pump operating speed in response to pump operating speed exceeding a first threshold value; and a step of adjusting the first threshold value;

wherein the step of adjusting the first threshold value is in response to a measure of pressure at the air inlet; and wherein the step of adjusting the first threshold value in response to the measure of pressure at the air inlet further comprises adjusting the first threshold value in response to a time integration of the measure of pressure at the air inlet.

2. The method of claim 1 wherein the step of measuring the pressure at the air inlet further comprises measuring the frequency of the pressure measured at the air inlet.

3. The method of claim 2 further comprises waiting a first time period after pump operating speed has been reduced; and increasing pump operating speed after waiting the first time period.

4. The method of claim 1 further comprises adjusting the first threshold value according to a user input.

5. The method of claim 1 further comprises determining the first threshold value according to the pump operating speed sensed.

6. The method of claim 1 further comprises determining the first threshold value according to a time integration of the pump operating speed sensed.

7. The method of claim 1 wherein the step of sensing pump operating speed further comprises measuring the pressure at least one of the air exhaust, the liquid inlet and the liquid outlet.

8. The method of claim 7 wherein the step of measuring the pressure in at least one of the air exhaust, the liquid inlet and the liquid outlet further comprises measuring a periodicity of pressure changes in at least one of the air exhaust, the liquid inlet and the liquid outlet.

9. The method of claim 7 further comprises adjusting the first threshold value in response to a time integration of the measure of pressure in at least one of the air exhaust, the liquid inlet and the liquid outlet.

10. The method of claim 1 further comprises increasing pump operating speed in response to pump operating speed falling below a second threshold value.

11. The method of claim 1 further comprises waiting a time period after pump operating speed has been reduced; verifying that pump operating speed was not below a second threshold value during the time period; and increasing pump operating speed.

12. The method of claim 1 further comprises accepting a user-inputted time period; waiting the user-inputted time period after pump operating speed has been reduced; verifying that pump operating speed did not exceed the first threshold value during the user-inputted time period; and increasing pump operating speed.

13. The method of claim 1 further comprises accepting a user-initiated trigger after pump operating speed has been reduced; and increasing pump operating speed after accepting the user-initiated trigger.

14. The method of claim 1 wherein the step of reducing pump operating speed further comprises turning off the pump.

15. The method of claim 1 wherein the liquid pump assembly further comprises a liquid output valve in fluid communication with the liquid outlet and wherein the step of reducing pump operating speed further comprises restricting liquid flow through the liquid output valve.

16. The method of claim 1 further comprises providing an air exhaust valve in fluid communication with the air exhaust and wherein the step of reducing pump operating speed comprises restricting air flow through the air exhaust valve.

17. The method of claim 1 wherein the air operated diaphragm pump comprises a pump chamber diaphragm and wherein the step of sensing pump operating speed further comprises measuring the position over time of the pump chamber diaphragm.

18. The method of claim 1 wherein the step of sensing pump operating speed further comprises measuring the pressure at a location in fluid communication with the air inlet.

19. The method of claim 18 wherein the step of measuring the pressure at a location in fluid communication with the air inlet further comprises determining a frequency of pressure changes at the air inlet.

20. A method for controlling a liquid pump assembly comprising the steps of: providing a liquid pump assembly comprising an air operated diaphragm pump, an air inlet, an air exhaust, a liquid inlet, and a liquid outlet; sensing pump operating speed which comprises the step of measuring the pressure at least one of the air exhaust, the liquid inlet and the liquid outlet; reducing pump operating speed in response to pump operating speed exceeding a first threshold value; accepting a user-inputted time period; waiting the user-inputted time period after pump operating speed has been reduced; increasing pump operating speed: and adjusting the first threshold value in response to a time integration of the measure of pressure in at least one of the air exhaust, the liquid inlet and the liquid outlet.

21. The method of claim 20 wherein the step of sensing pump operating speed further comprises measuring the pressure at the air inlet.

22. The method of claim 21 wherein the step of measuring the pressure at the air inlet further comprises measuring a frequency of the pressure measured at the air inlet.

23. The method of claim 22 further comprises: waiting a first time period after pump operating speed has been reduced; and increasing pump operating speed after waiting the first time period.

24. The method of claim 21 further comprises adjusting the first threshold value in response to the measure of pressure at the air inlet.

25. The method of claim 24 wherein the step of adjusting the first threshold value in response to the measure of pressure at the air inlet further comprises adjusting the first threshold value in response to a time integration of the measure of pressure at the air inlet.

26. The method of claim 20 further comprises adjusting the first threshold value according to a user input.

27. The method of claim 20 further comprises determining the first threshold value according to the pump operating speed sensed.

28. The method of claim 20 further comprising the step of determining the first threshold value according to a time integration of the pump operating speed sensed.

29. The method of claim 20 wherein the step of measuring the pressure in at least one of the air exhaust, the liquid inlet and the liquid outlet further comprises measuring a periodicity of pressure changes in at least one of the air exhaust, the liquid inlet and the liquid outlet.

30. The method of claim 20 further comprises increasing pump operating speed in response to pump operating speed falling below a second threshold value.

31. The method of claim 20 further comprises: waiting a time period after pump operating speed has been reduced; verifying that pump operating speed was not below a second threshold value during the time period; and increasing pump operating speed.

32. The method of claim 20 further comprises: accepting a user-initiated trigger after pump operating speed has been reduced; and increasing pump operating speed after accepting the user-initiated trigger.

33. The method of claim 20 wherein the step of reducing pump operating speed further comprises turning off the pump.

34. The method of claim 20 wherein the liquid pump assembly further comprises a liquid output valve in fluid communication with the liquid outlet and wherein the step of reducing pump operating speed further comprises restricting liquid flow through the liquid output valve.

35. The method of claim 20 further comprises providing an air exhaust valve in fluid communication with the air exhaust and wherein the step of reducing pump operating speed further comprises restricting air flow through the air exhaust valve.

36. The method of claim 20 wherein the AOD pump comprises a pump chamber diaphragm and wherein the step of sensing pump operating speed further comprises measuring the position over time of the pump chamber diaphragm.

37. The method of claim 20 wherein the step of sensing pump operating speed further comprises measuring the pressure at a location in fluid communication with the air inlet.

38. The method of claim 37 wherein the step of measuring the pressure at a location in fluid communication with the air inlet further comprises determining the frequency of pressure changes at the air inlet.

39. A method for controlling a liquid pump assembly comprising the steps of: providing a liquid pump assembly comprising an air operated diaphragm pump, an air inlet, an air exhaust, a liquid inlet, and a liquid outlet; sensing pump operating speed; reducing pump operating speed in response to pump operating speed exceeding a first threshold value; waiting a time period after pump operating speed has been reduced; verifying that pump operating speed was not below a second threshold value during the time period; and increasing pump operating speed.

* * * * *